US007100806B2

(12) United States Patent
Schuster et al.

(10) Patent No.: US 7,100,806 B2
(45) Date of Patent: Sep. 5, 2006

(54) CONDIMENT SHAKER

(75) Inventors: Christopher John Schuster, Batavia, OH (US); Daniel J. Reed, Blanchester, OH (US)

(73) Assignee: Sure Shake, LLC, Batavia, OH (US)

( * ) Notice: Subject to any disclaimer, the term of this patent is extended or adjusted under 35 U.S.C. 154(b) by 0 days.

(21) Appl. No.: 10/922,295

(22) Filed: Aug. 19, 2004

(65) Prior Publication Data

US 2006/0037978 A1 Feb. 23, 2006

(51) Int. Cl.
*B65D 47/00* (2006.01)

(52) U.S. Cl. ..... 222/546; 222/142.1; 222/498; 222/517; 222/556; 222/565; 220/254.2; 220/254.3

(58) Field of Classification Search ..... 222/517, 222/565, 562–563, 142.1, 183, 546–547, 222/498, 543, 556; 215/235, 237, 244–245, 215/295, 301, 305; 220/254.3, 835, 254.2, 220/266

See application file for complete search history.

(56) References Cited

U.S. PATENT DOCUMENTS 2,037,172 A * 4/1936 Leffert ..... 220/315
2,263,783 A * 11/1941 Langenstein ..... 222/517
2,474,678 A 6/1949 Kitchen ..... 65/57
2,695,732 A * 11/1954 Tupper ..... 222/189.02
2,940,645 A * 6/1960 Albiani ..... 222/480
3,131,824 A * 5/1964 Van Baarn ..... 222/153.07
3,741,447 A * 6/1973 Miles et al. ..... 222/517
4,009,794 A * 3/1977 Zapp ..... 215/210
4,106,672 A * 8/1978 Tecco et al. ..... 222/151
4,305,515 A * 12/1981 Tontarelli ..... 215/244
4,625,898 A * 12/1986 Hazard ..... 222/517
4,711,360 A * 12/1987 Ullman ..... 215/235
4,805,790 A * 2/1989 Leonetti et al. ..... 215/235
4,838,441 A * 6/1989 Chernack ..... 215/216
5,192,005 A 3/1993 Zimmerman ..... 222/148
5,205,424 A * 4/1993 Gaspar ..... 215/210
5,395,015 A * 3/1995 Bolen et al. ..... 222/546
5,597,096 A 1/1997 Jeppesen et al. ..... 222/498
5,901,885 A * 5/1999 Iida ..... 222/517

* cited by examiner

*Primary Examiner*—Frederick C. Nicolas
(74) *Attorney, Agent, or Firm*—Wood, Herron & Evans, L.L.P.

(57) ABSTRACT

A condiment shaker includes a flip top lid having pins configured to travel through dispensing openings in the shaker top.

8 Claims, 2 Drawing Sheets

CONDIMENT SHAKER

FIELD OF THE INVENTION

The present invention relates to containers for dispensing materials stored therewithin, and more particularly, to shakers for granular condiments.

BACKGROUND OF THE INVENTION

Salt and other condiments shakers are commonly used to store and dispense salt, pepper or other spices. The shakers generally consist of a hollow container having a screw or push-on top. The top is removed while the shaker is filled with condiment. The top includes several openings through which the contained condiment can be shaken through once the top is secured.

Condiments, particularly salt, tends to absorb moisture from outside air that enters the shaker. Such moisture often imparts undesirable qualities to the stored condiment, and can among other problems, clog dispensing openings. Protective covers used to minimize moisture can be difficult and inconvenient to manipulate. For instance, caps having pins to clean the dispensing holes must be screwed onto a shaker to remove debris. This requirement is inconvenient for the user and prone to spills.

There is therefore a need for an improved condiment shaker.

SUMMARY OF THE INVENTION

The present invention provides an improved condiment shaker having a flip top lid that includes pins or other projections positionable into dispensing holes. More particularly, an embodiment of the condiment shaker includes a hollow container configured to hold a condiment or other material to be dispensed. The container includes an opening configured to allow the through flow of the material from within the container.

A container top integral with the container includes an opening configured to allow the through flow of the material. The container top may be attached and/or integrally configured with the container. A flip top lid is biased against the container top. The flip top lid includes a projection positioned on an underside lid surface that opposes the container top. The projection is configured to travel through the opening in the container top.

The flip top lid pivots on an axis, and a handle of the condiment shaker permits opening of the flip top lid with one hand. The shape of the projection may be configured to mate with the shape of the opening. This feature helps seal moisture out and condiment material in. The surface of the container top may be contoured, and an inner lid surface may include contours corresponding to those of the contoured surface. This feature may thus provide further sealing. A seal made of plastic, rubber or another suitable synthetic may be positioned within the flip top lid to provide additional sealing. Fasteners may be used to optionally hold the lid in a closed or open position.

The anti-clogging feature of the projections enables smaller openings because there will be less incidences of clogging. This enables more control of the amount of material that is dispensed by the condiment shaker. This feature further enables finer granularity of the material, such as a finer salt.

These and other objects and advantages of the present invention will become more readily apparent during the following detailed description taken in conjunction with the drawings herein.

DETAILED DESCRIPTION OF THE INVENTION

Figure 1:
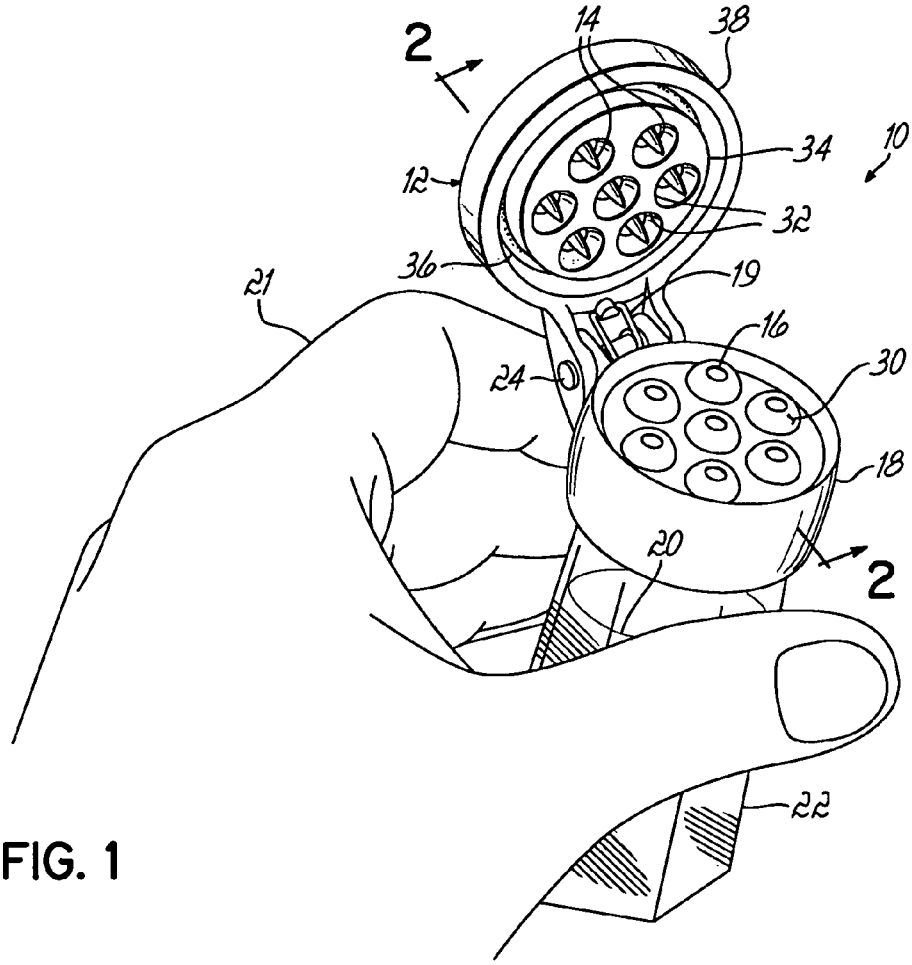
FIG. 1 shows a condiment shaker having a flip top lid with projections that travel through openings in the shaker top.

FIG. 1 shows an improved condiment shaker 10 that includes a flip top lid 12. The flip top lid 12 includes projections 14 that are configured to travel through openings 16 in a container top 18. To this end, the lid 12 shown in FIG. 1 is biased towards the container top 18 such that the projections 14 reside in the openings 16 until the lid 12 is flipped opened by a user 21. That is, the flip top lid 12 is generally biased closed. While one skilled in the art will appreciate that other biasing mechanisms may be used in accordance with the principles of the present invention, a spring 19 is used in the embodiment of FIG. 1.

Figure 2:
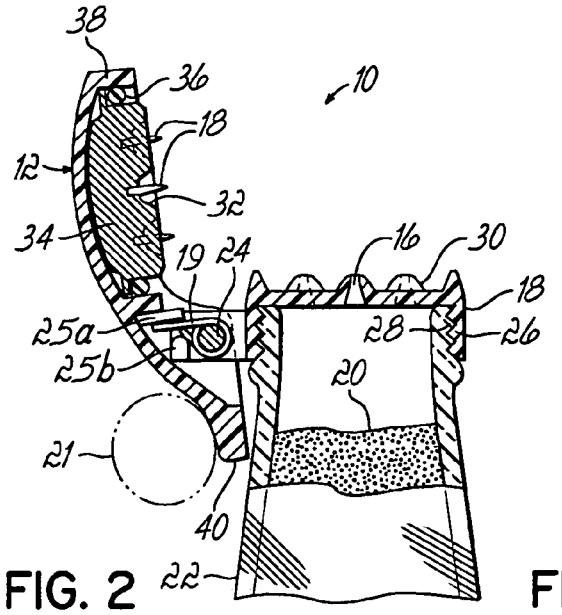
FIG. 2 shows a cross-sectional view of the condiment shaker of FIG. 1 taken along line 2—2 with the flip top lid in the open position.
Figure 3:
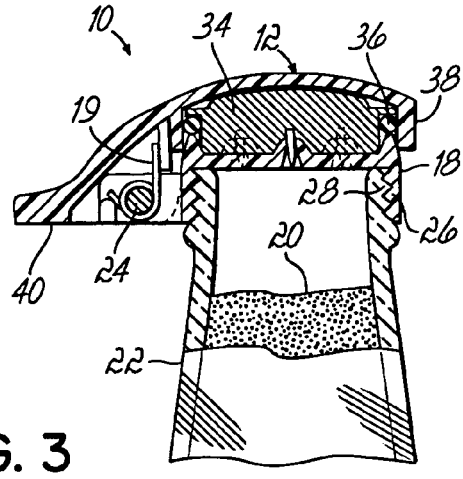
FIG. 3 shows a cross-sectional view of the condiment shaker of FIG. 1 taken along line 2—2 with the flip top lid in the closed position.

When the flip top lid 12 is in a closed position as shown in FIG. 3, the projections 14 function, in part, to clear the openings 16 of any material 20 that might otherwise clog the openings 16. When in an open position, as shown in FIGS. 1 and 2, condiment or other material 20 contained within a hollow container 22 may be shaken out of the shaker 10 through the openings 16 in the container top 18.

The anti-clogging feature of the projections 14 enables smaller openings 16 because there will be less incidences of clogging. This enables more control of the amount of material 20 that is dispensed by the condiment shaker 10. This feature further enables finer granularity of the material 20, such as a finer salt.

The container top 18 as shown attaches to the flip top lid 12 via an elongated pivoting fastener 24. The spring 19 wraps around the pivoting fastener 24 and communicates with spring stops 25*a* and 25*b*. The flip top lid 12 is thus configured to rotate relative to the container top 18 along an axis defined by the pivoting fastener 24.

As shown in the embodiment of FIG. 1, the container top comprises part of a top 18 and lid 12 that form a combination configured to attach to the container 22. The container top 18 attaches onto the container 22 in any manner known in the art, for instance, using mating threaded surfaces 26, 28 respectively, as best shown in FIG. 2. One skilled in the art will appreciate that a container top of another embodiment may attach via a snapping action or other known fastening mechanism. Moreover, the container top may be manufactured integrally with the container. The container top 18 may further be unfastened from the container 22 to allow refilling of the material 20 inside the hollow container 22. One skilled in the art will recognize that the container of another embodiment may be alternatively filled via another opening.

A contoured surface 30 of the container top 18 is raised circumferentially around the openings 16. Corresponding recesses 32 inside an inner lid surface 34 of the flip top lid 12 are aligned and otherwise mate with the contoured surface 30 to form a seal. The inner lid surface 34 may be constructed from plastic, metal, rubber or any synthetic material, as may be the projections 14, lid 12 and container top 18. Inner lid surface may be attached to and/or may be manufactured integrally with the flip top lid.

The projections 14, themselves, may function to seal the openings 16 when the flip top lid is in a closed position, as shown in FIG. 3. Moreover, a seal 36 included within the flip top lid 12 functions to keep air and moisture away from the material 20 within the container 22. One skilled in the art will appreciate that the seal 36 may comprise any material configured to prevent dispersion of moisture, but is typically made of rubber. A lid lip 38 disposed circumferentially around the flip top lid 12 extends over the container top 18 when closed. These features, alone and in combination, act to keep moisture and other contaminants from the material. In one embodiment, the condiment shaker 10 is water resistant and/or waterproof. Such a feature may have particular application in outdoor settings, e.g., backpacking, camping, military manoeuvres, etc.

In addition to keeping moisture out of the contents of the container 22, the projections 14, lid 12 and other physical features of the invention additional function to keep the material 20 inside the shaker 10. That is, an embodiment of the present invention is also spill proof.

Figure 4:
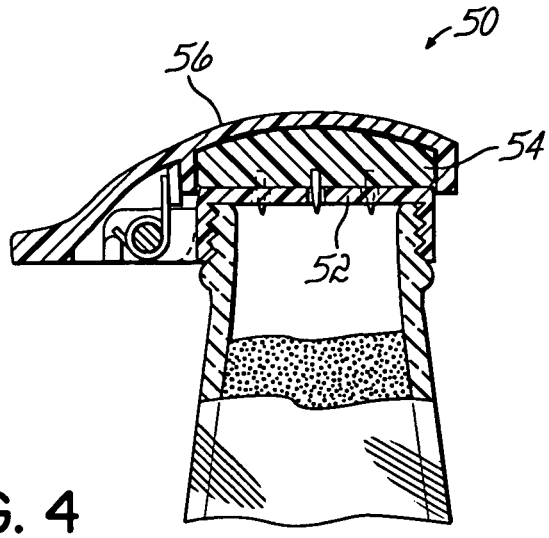
FIG. 4 shows a cross-sectional perspective of a condiment shaker similar to that shown in FIG. 1, but without an inner lid or contoured dispensing surface.

The shaker 50 shown in FIG. 4 is similar to that shown in FIGS. 1–3, but features a smooth top surface 52. Likewise, the underside surface 54 of the flip top lid 56 is uncontoured. No structure comparable to the rubber seal 36 of FIG. 1 is included in the embodiment of FIG. 4.

Figure 5:
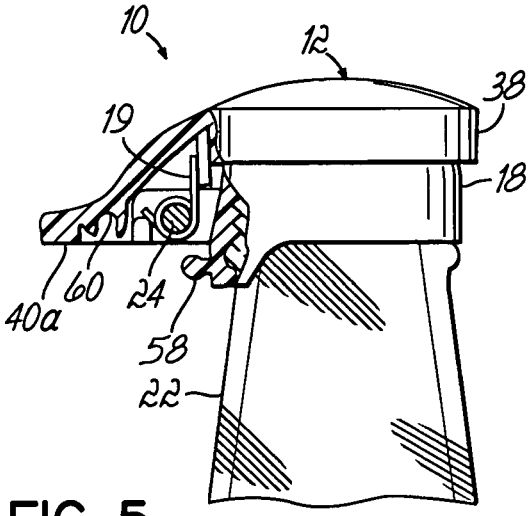
FIG. 5 shows a cross-sectional perspective of a condiment shaker similar to that shown in FIG. 1, but with a fastener configured to hold the lid in an open position.
Figure 6:
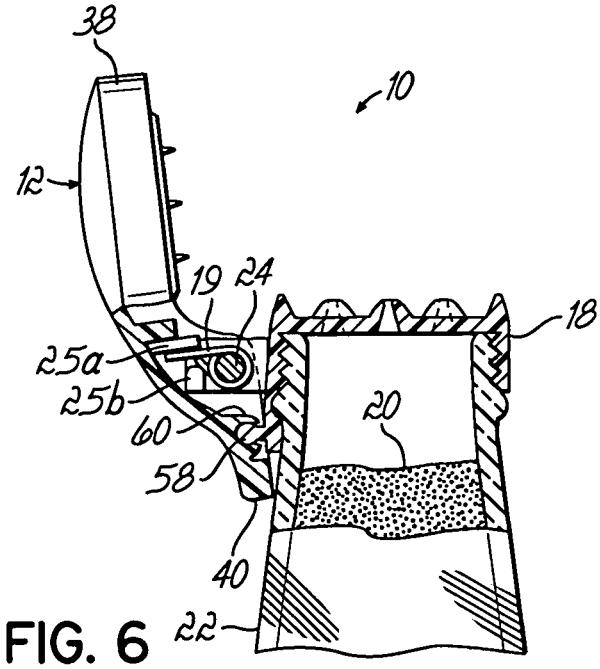
FIG. 6 shows a cross-sectional perspective of a condiment shaker of FIG. 5 in a closed position.

The shaker 50 shown in FIG. 5 is similar to that shown in FIGS. 1–3, but features a fastener configured to hold the lid 12 in an opened position. As such, the fastener comprises an extension 58 and a recess 60 configured to temporarily receive and secure the extension 58, as shown best in FIG. 6. While the snap action of the ball-catch fastener shown in FIGS. 5 and 6 may have particular application in certain embodiments that are consistent with the principles of the invention, one skilled in the art will appreciate that other fasteners useful in holding the lid of another embodiment may alternatively be employed, such as those fasteners including latches or magnets, as are known in the art.

While the present invention has been illustrated by a description of various embodiments and while these embodiments have been described in considerable detail in order to describe a mode of practicing the invention, it is not the intention of Applicant to restrict or in any way limit the scope of the appended claims to such detail. For instance, one skilled in the art will appreciate that any variations of a handle may be accomplished in accordance with the principles of the present invention, including a handle that extends down towards the base of the container. The lid of another or the same embodiment may incorporate a strap, button snap, spring and hook mechanism or other fastener to further secure the lid in a closed position when not in use.

While the embodiments are described above in the context of condiment dispensing, one skilled in the art will appreciate that the principles of the present invention may apply to other materials. For instance, the features of the present invention may apply equally to dispensing material that includes liquids and powders, e.g., pancake syrup and baby powder. It should be further understood that the projections are configured to allow customizable flow of the material through the openings according to how far the user allows the projections to be inserted into the openings. This feature allows for more precise material dispensing by a user. Additional advantages and modifications within the spirit and scope of the invention will readily appear to those skilled in the art.

The invention claimed is:

1. An apparatus for dispensing granula material comprising:

a hollow container having a horizontal bottom surface and a sidewall extending upwards and vertically from the bottom surface, the hollow container configured to hold the material;

a container top located proximate a top portion of the container and including a top surface having a plurality of openings configured to allow the through-flow of the material, wherein the container top includes a contoured surface that is circumferentially raised around each of the plurality of openings;

a flip top lid configured to pivot on an axis, the flip top lid biased by a spring towards the top surface of the container, the flip top lid including a plurality of conical projections positioned on an underside surface of the flip top lid and configured to travel through the respective openings in the container top, wherein the flip top lid includes a lip configured to extend over the container top, wherein the flip top lid includes an inner lid surface having a recess aligned with at least one opening of the contoured surface of the plurality of openings to form a seal, wherein both the flip top lid and the container top are substantially circular in shape, and the flip top lid has a larger diameter than the container top wherein the projections and openings mate to form a moisture seal; and a handle extending horizontally out from the hollow container, the handle operatively connected to the flip top lid such a downward vertical force applied to the handle causes the flip top lid to open.

2. The apparatus according to claim 1 wherein the handle permits opening of the flip top lid with one hand of a user.

3. The apparatus of claim 1 wherein the container top is integral with the container.

4. The apparatus of claim 1 wherein the container top is removable from the container.

5. The apparatus of claim 1 wherein the flip top lid includes a seal.

6. The apparatus of claim 1 further comprising a fastener configured to secure the flip top lid in a closed position.

7. The apparatus of claim 6 wherein the fastener includes a snap mechanism.

8. The apparatus of claim 1 further comprising a second fastener configured to secure the flip top lid in an opened position.

* * * * *